US011448408B2

(12) United States Patent
Cho et al.

(10) Patent No.: US 11,448,408 B2
(45) Date of Patent: Sep. 20, 2022

(54) MULTI-TYPE AIR CONDITIONER

(71) Applicant: LG ELECTRONICS INC., Seoul (KR)

(72) Inventors: Eunjun Cho, Seoul (KR); Yongcheol Sa, Seoul (KR); Jiyoung Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/962,929

(22) PCT Filed: Jan. 18, 2019

(86) PCT No.: PCT/KR2019/000785
§ 371 (c)(1),
(2) Date: Jul. 17, 2020

(87) PCT Pub. No.: WO2019/143195
PCT Pub. Date: Jul. 25, 2019

(65) Prior Publication Data

US 2021/0131695 A1 May 6, 2021

(30) Foreign Application Priority Data

Jan. 19, 2018 (KR) ..... 10-2018-0007094

(51) Int. Cl.
*F24F 3/06* (2006.01)
*F24F 11/70* (2018.01)
(Continued)

(52) U.S. Cl.
CPC ..... *F24F 3/06* (2013.01); *F24F 11/70* (2018.01); *F25B 5/02* (2013.01); *F25B 6/02* (2013.01);
(Continued)

(58) Field of Classification Search
CPC ..... F24F 11/70; F24F 2003/1446; F24F 2110/10; F25B 2313/0212; F25B 41/30; F25B 49/02; F25B 6/02
See application file for complete search history.

(56) References Cited

U.S. PATENT DOCUMENTS 7,493,775 B2 * 2/2009 Shimamoto ..... F24F 3/065 62/199
2010/0125370 A1 * 5/2010 Baba ..... F24F 11/30 700/276
2010/0293976 A1 * 11/2010 Tsutsumi ..... F24F 1/00077 62/176.6

FOREIGN PATENT DOCUMENTS

JP 08428748 5/1996
JP 2005-283058 10/2005
(Continued)

OTHER PUBLICATIONS

International Search Report (with English Translation) dated May 10, 2019 issued in Application No. PCT/KR2019/000785.
(Continued)

*Primary Examiner* — Henry T Crenshaw
(74) *Attorney, Agent, or Firm* — KED & Associates

(57) ABSTRACT

A multi-type air conditioner is provided that includes an outdoor unit having a liquid pipe through which a liquid refrigerant flows, and a gas pipe through which a gas refrigerant flows; a plurality of indoor units including a first indoor unit and a second indoor unit each connected to the liquid pipe and the gas pipe to circulate a refrigerant; a gas pipe connecting tube connecting the gas pipe and the plurality of indoor units so that a gas refrigerant flows therethrough; and a liquid pipe connecting tube connecting the liquid pipe and the plurality of indoor units so that a liquid refrigerant flows therethrough.

11 Claims, 6 Drawing Sheets

(51) Int. Cl.

| | |
|---|---|
| ***F25B 5/02*** | (2006.01) |
| ***F25B 6/02*** | (2006.01) |
| ***F25B 49/02*** | (2006.01) |
| ***F25B 41/20*** | (2021.01) |
| ***F24F 110/10*** | (2018.01) |
| ***F24F 3/14*** | (2006.01) |

(52) U.S. Cl.
CPC ..... *F25B 41/20* (2021.01); *F25B 49/02* (2013.01); *F24F 2003/1446* (2013.01); *F24F 2110/10* (2018.01); *F25B 2313/0212* (2013.01)

(56) References Cited

FOREIGN PATENT DOCUMENTS

| | | |
|---|---|---|
| JP | 2005 283058 | * 10/2013 |
| KR | 10-1997-0062570 | 9/1997 |
| KR | 10-2005-0049954 | 9/1997 |
| KR | 10-2006-0075942 | 7/2006 |
| KR | 10-2007-0009081 | 1/2007 |
| KR | 10-0863284 | 10/2008 |
| KR | 10-1105953 | 1/2012 |
| KR | 10-1624529 | 6/2016 |

OTHER PUBLICATIONS

Korean Notice of Allowance dated May 26, 2022 issued in Application No. 10-2018-0007094.

* cited by examiner

MULTI-TYPE AIR CONDITIONER

TECHNICAL FIELD

The present disclosure relates to a multi-type air conditioner, and more particularly, to a multi-type air conditioner capable of performing dehumidification while maintaining a temperature of indoor air at a constant level.

BACKGROUND ART

An air conditioner refers to a device that cools/heats a room or purifies indoor air to create a more comfortable indoor environment for a user.

At present, for effective cooling or heating of a space partitioned into many rooms, there have been ceaseless developments of multi-type air conditioners.

The multi-type air conditioner is in general provided with one outdoor unit and a plurality of indoor units each connected to the outdoor unit and installed in a room, for cooling or heating the room while operating in one of cooling, heating, and dehumidifying mode.

If any one indoor unit is operating in the dehumidifying mode while a plurality of indoor unit operates in the cooling mode, the indoor unit operating in the dehumidifying mode discharges air of a temperature lower than a room temperature, so it is not possible to maintain the room temperature at a constant level.

RELATED PATENT DOCUMENT

Patent Document

Korean Patent Application Publication No. 10-1997-0062570 A

DISCLOSURE

Technical Problem

An object of the present disclosure is to provide a multi-type air conditioner capable of performing dehumidification while maintaining a temperature of indoor air at a constant level.

Technical Solution

A multi-type air conditioner according to the present disclosure is capable of performing dehumidification while maintaining a temperature of indoor air at a constant level.

According to an aspect of the present disclosure, there is provided a multi-type air conditioner, including: an outdoor unit having a liquid pipe through which a liquid refrigerant flows, and a gas pipe through which a gas refrigerant flows; a plurality of indoor units comprising a first indoor unit and a second indoor unit each connected to the liquid pipe and the gas pipe to circulate a refrigerant; a gas pipe connecting tube connecting the gas pipe and the plurality of indoor units so that a gas refrigerant flows therethrough; and a liquid pipe connecting tube connecting the liquid pipe and the plurality of indoor units so that a liquid refrigerant flows therethrough, The first indoor unit may include: a first indoor heat exchanger comprising a first heat exchanger configured to perform heat exchange between indoor air and a refrigerant, and a second heat exchanger configured to perform heat exchange between indoor air and a refrigerant and arranged in a stacked fashion with the first heat exchanger; a first indoor fan configured to blow air to the first heat exchanger and the second heat exchanger; a first liquid branch pipe connecting the liquid pipe connecting tube and the first heat exchanger so that a refrigerant flows therethrough; a first gas branch pipe connecting the gas pipe connecting tube and the second heat exchanger so that a refrigerant flows therethrough; a first heat exchanger connecting pipe connected to the first heat exchanger so that a refrigerant flows therethrough; a second heat exchanger connecting pipe connected to the second heat exchanger so that a refrigerant flows therethrough; a return pipe having one side connected to the first gas branch pipe and the other side connected to the first heat exchanger connecting pipe and the second heat exchanger connecting pipe; a first indoor expansion valve disposed at the second heat exchanger connecting pipe, wherein an opening amount of the first indoor expansion valve is adjusted in response to an input signal from a controller to selectively expand a flowing refrigerant; and a first expansion valve disposed in the return pipe, wherein an opening amount of the first expansion valve is adjusted in response to an input signal from the controller to selectively expand a flowing refrigerant.

During a constant temperature dehumidifying operation of the first indoor unit, the first indoor expansion valve may be opened and the first expansion valve may be closed.

During the constant temperature dehumidifying operation of the first indoor unit, a refrigerant supplied to the first indoor unit may be in a gaseous state and a liquid state.

During a cooling operation of the first indoor unit, the first indoor expansion valve may be opened and the first expansion valve may be closed.

During the cooling operation of the first indoor unit, a refrigerant supplied to the first indoor unit may be in a liquid phase.

The multi-type air conditioner may further include a second expansion valve disposed at the first liquid pipe branch pipe, and an opening amount of the second expansion valve may be adjusted in response to an input signal from the controller to selectively expand a flowing refrigerant.

During a constant temperature dehumidifying operation of the first indoor unit, the first indoor expansion valve may be opened, the first expansion valve may be closed, and the second expansion valve may be opened.

During the cooling operation of the first indoor unit, the second expansion valve may be opened, the first indoor expansion valve may be opened, and the first expansion valve may be closed.

The multi-type air conditioner may further include: a heat exchanger bypass pipe connecting the first liquid branch pipe and the second heat exchanger connecting pipe; and a third expansion valve disposed at the heat exchanger bypass pipe, wherein an opening amount of the third expansion valve is adjusted in response to an input signal from the controller to selectively expand a flowing refrigerant.

During a constant temperature dehumidifying operation of the first indoor unit, the first indoor expansion valve may be opened, the first expansion valve may be closed, and the third expansion valve may be closed.

During the cooling operation of the first indoor unit, the third expansion valve may be opened, the first indoor expansion valve may be closed, and the first expansion valve may be closed.

Advantageous Effects

The multi-type air conditioner of the present disclosure has one or more of the following effects.

First, the multi-type air conditioner according to the present disclosure can connect a plurality of indoor units and outdoor units with only a liquid pipe and a gas pipe, and operate at least one of the plurality of indoor units in a constant temperature dehumidification mode.

Second, since the multi-type air conditioner according to the present disclosure can operate a first heat exchanger as a condenser and operate a second heat exchanger as an evaporator, it is possible to constantly operate a dehumidifying mode while maintaining a room temperature within a constant range.

The effects of the present disclosure will not be limited only to the effects described above, and, accordingly, other effects that have not been mentioned above may become apparent to those having ordinary skill in the art from the description presented below.

MODE FOR DISCLOSURE

Figure 1:
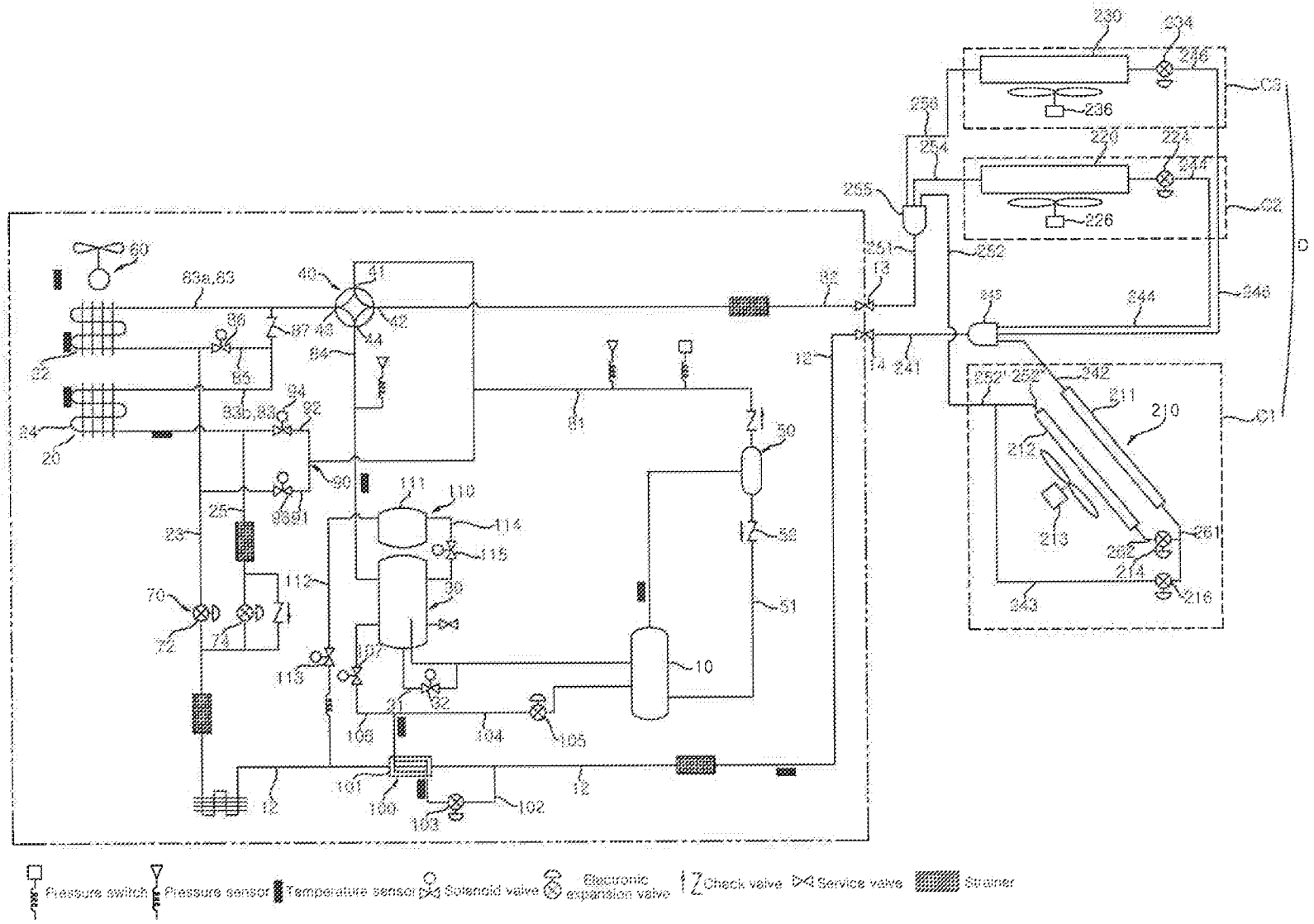
FIG. 1 is a block diagram of a multi-type air conditioner according to a first embodiment of the present disclosure.

Advantages and features of the present disclosure, and methods for achieving them will be clarified with reference to embodiments described below in detail together with the accompanying drawings. However, the present disclosure is not limited to the embodiments disclosed below, but may be implemented in various different forms, and only the embodiments allow the disclosure of the present disclosure to be complete, and common knowledge in the technical field to which the present disclosure pertains. It is provided to fully inform the person having the scope of the invention, and the present disclosure is only defined by the scope of the claims. The same reference numerals refer to the same components throughout the specification.

Hereinafter, the present disclosure will be described in detail with reference to the accompanying drawings.

Figure 2:
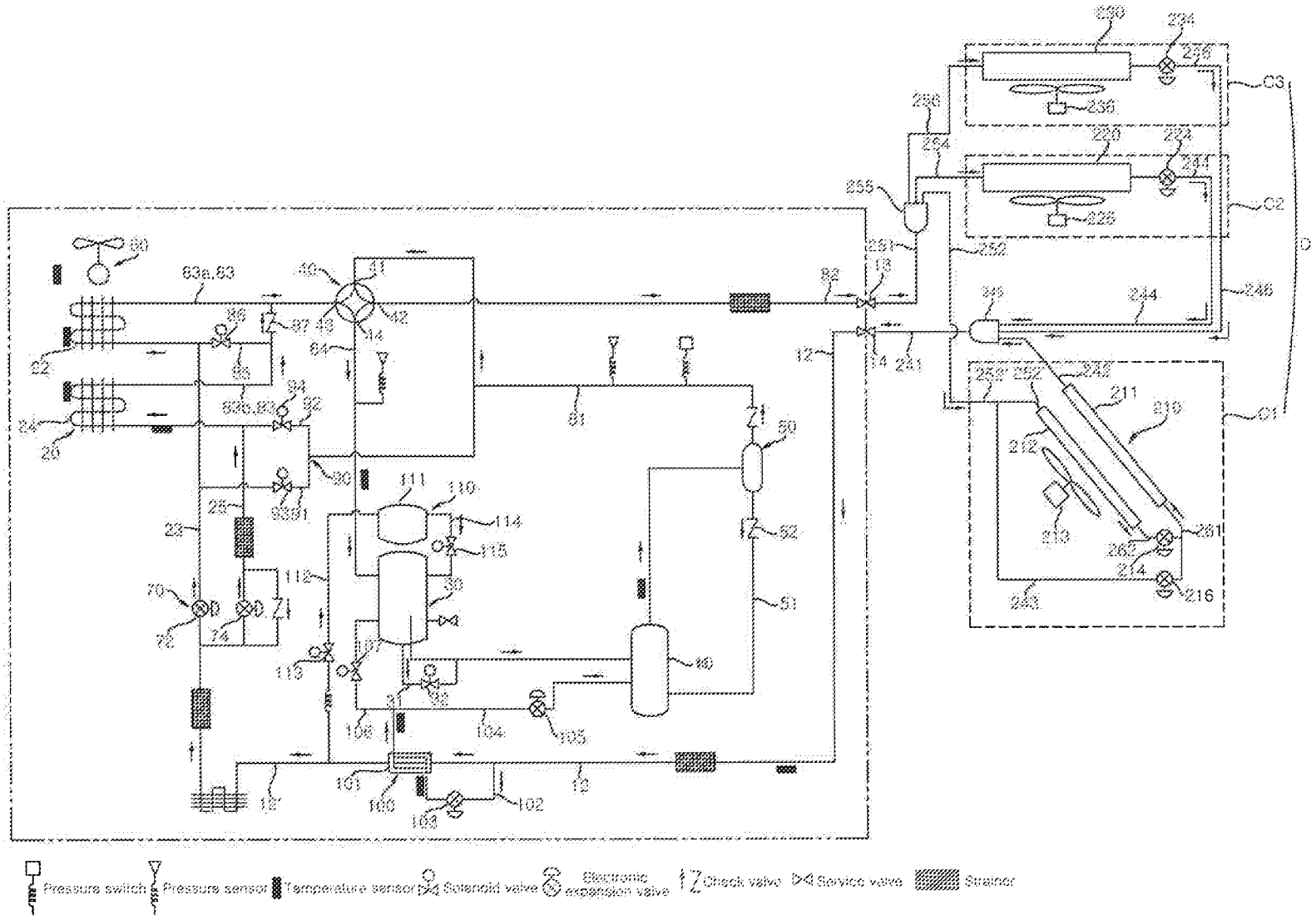
FIG. 2 is an exemplary diagram illustrating a refrigerant flow during a heating operation in the multi-type air conditioner illustrated in FIG. 1.
Figure 3:
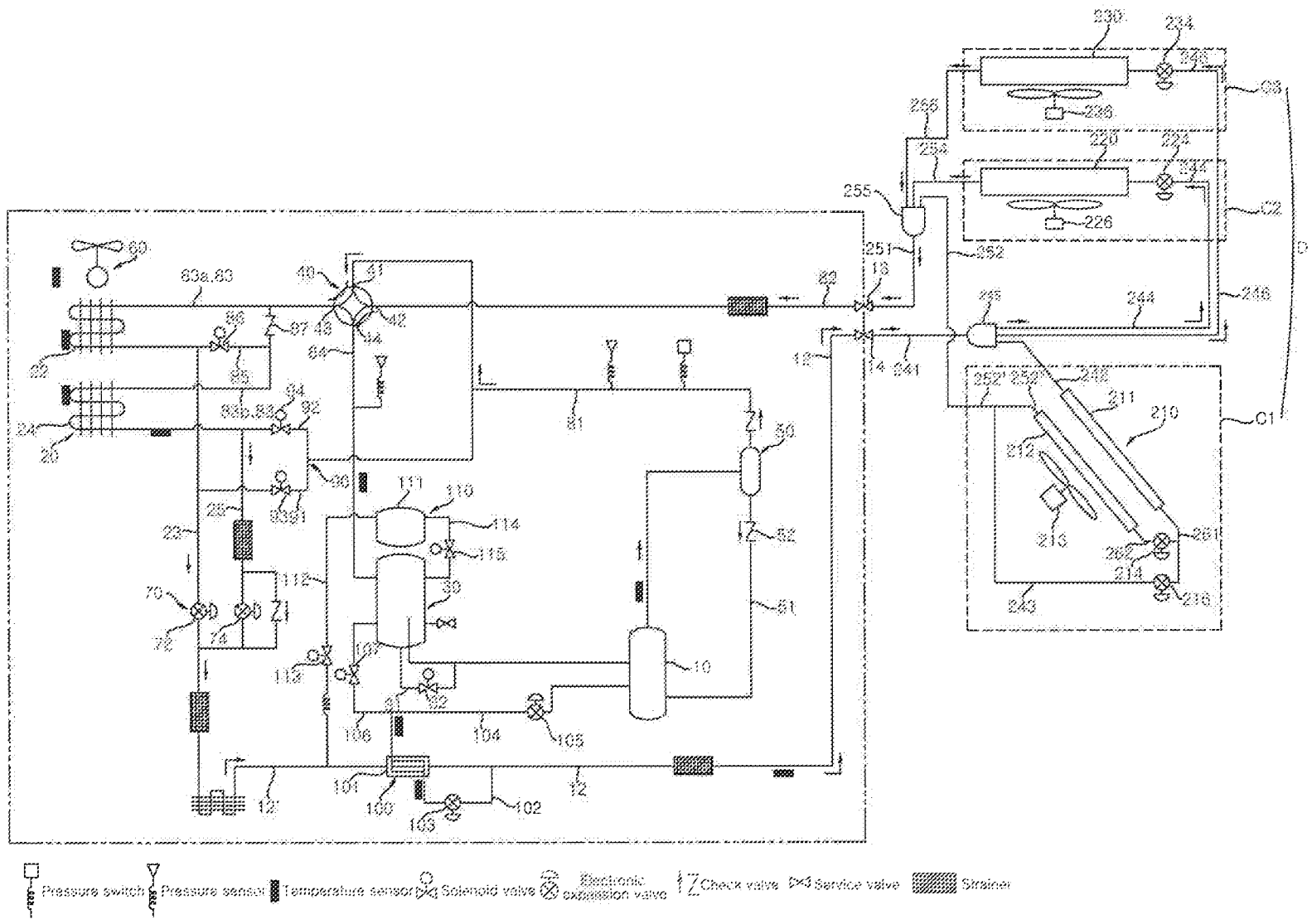
FIG. 3 is an exemplary diagram illustrating a refrigerant flow during a cooling operation in the multi-type air conditioner illustrated in FIG. 1.

FIG. 1 is a diagram illustrating a configuration of a multi-type air conditioner according to a first embodiment of the present disclosure, FIG. 2 is an exemplary diagram illustrating a refrigerant flow during a heating operation in the multi-type air conditioner shown in FIG. 1, and FIG. 3 is an exemplary diagram illustrating a refrigerant flow during a cooling operation in the multi-type air conditioner shown in FIG. 1.

The multi-type air conditioner according to the present disclosure includes an outdoor unit A and an indoor unit D.

The indoor unit D may operate for cooling or heating. The plurality of indoor unit D may be provided as a plurality of indoor units C1, C2, and C3.

The plurality of indoor units C1, C2, and C3 each includes an indoor heat exchanger, an indoor expansion valve, and an indoor blower fan.

Although not additionally described, various structures which can be sufficiently known to a person skilled in the art, such as a pressure switch, a pressure sensor, a temperature sensor, a check valve, a strainer, and the like, are installed in the outdoor unit A or the indoor unit D.

<Configuration of Outdoor Unit>

The outdoor unit A includes an outdoor unit case (not shown), a compressor 10 disposed therein, an outdoor heat exchanger 20, an accumulator 30, a four way valve 40, an oil separator 50, an outdoor expansion valve 70, a hot gas unit 90, and a subcooling unit 100.

The outdoor unit case includes a gas pipe service valve 13 to which the gas piping 82 is connected, and a liquid piping service valve 14 to which the liquid piping 12 is connected.

The gas pipe service valve 13 and the liquid piping service valve 14 are connected through an indoor unit D and a refrigerant pipe, and circulate the refrigerant of the outdoor unit A.

The compressor 10 is an inverter compressor capable of controlling the amount of a refrigerant and a discharge pressure of the refrigerant by adjusting an operating frequency.

The outdoor heat exchanger 20 is a device for exchanging heat between outdoor air and a refrigerant. In this embodiment, the outdoor heat exchanger 20 may be configured as a plurality of outdoor heat exchangers. The outdoor heat exchanger 20 operates as a condenser during a cooling operation and as an evaporator during a heating operation.

In this embodiment, the outdoor heat exchanger 20 is composed of a first outdoor heat exchanger 22 and a second outdoor heat exchanger 24.

In order to improve the heat exchange of the outdoor heat exchanger 20, an outdoor blower fan 60 is disposed.

The accumulator 30 provides a refrigerant to the compressor 10. The accumulator 30 is disposed on a suction side of the compressor 10 and is connected to the four way valve 40.

<Configuration of Four Way Valve>

The four way valve 40 includes a first flow path 41, a second flow path 42, a third flow path 43, and a fourth flow path 44.

The first flow path 41 is connected to a discharge side of the compressor 10. A pipe connecting the first flow path 41 and the discharge side of the compressor 10 is defined as a four way valve-compressor connecting pipe 81.

The second flow path 42 is connected to the gas pipe 82. A pipe connecting the second flow path 42 and the gas pipe service valve 13 is defined as the gas piping 82.

The third flow path 43 is connected to the outdoor heat exchanger 20. A pipe connecting the third flow path 43 and the outdoor heat exchanger 20 is defined as a four way valve-outdoor heat exchanger connecting pipe 83.

Since the outdoor heat exchanger 20 is configured as two outdoor heat exchangers, two four way valve-outdoor heat exchanger connecting pipes 83 are disposed.

The four way valve-outdoor heat exchanger connecting pipe 83 includes a first four way valve-outdoor heat exchanger connecting pipe 83*a* that connects the first outdoor heat exchanger 22 and the four way valves 40 (the third flow path). The four way valve-outdoor heat exchanger connecting pipe 83 includes a four way valve-outdoor heat exchanger connecting pipe 83*b* that connects the second outdoor heat exchanger 24 and the four way valves 40 (the third flow path).

The first four way valve-outdoor heat exchanger connecting pipe 83*a* and the second four way valve-outdoor heat exchanger connecting pipe 83*b* are combined to be connected to the third flow path 43.

The fourth flow path 44 is connected to the accumulator 30. A pipe connecting the fourth flow path 44 and the accumulator 30 is defined as a four way valve-accumulator connecting pipe 84.

<Configuration of Oil Separator>

The oil separator 50 is disposed on a discharge side of the compressor 10, and a refrigerant discharged from the compressor 10 flows through the oil separator 50 to the four way valve 40.

The oil separator 50 recovers oil contained in the discharged refrigerant and provides the recovered oil to the compressor 10 again.

The oil separator 50 further include an oil recovering pipe 51 for guiding oil to the compressor 10, and a check valve 52 disposed in the oil recovering pipe 51 to guide a refrigerant to flow in one direction.

The oil separator 50 is installed at the four way valve-compressor connecting pipe 81.

The accumulator 30 is also provided with an oil recovering structure capable of recovering oil into the compressor 10. An oil return pipe 31 connecting a lower side of the accumulator 30 and a suction side pipe 35 of the compressor, and an oil return valve 32 disposed in the oil recovery pipe 31 to control the flow of the oil may be disposed.

<Configuration of Outdoor Expansion Valve>

During a heating operation, the outdoor expansion valve 70 expands a refrigerant flowing to the outdoor heat exchanger 20. During a cooling operation, the outdoor expansion valve 70 allows the refrigerant to pass therethrough without expansion. The outdoor expansion valve 70 may be an electronic expansion valve capable of adjusting an opening value according to an input signal.

The outdoor expansion valve 70 includes a first outdoor expansion valve 72 for expanding a refrigerant flowing to the first outdoor heat exchanger 22, and a second outdoor expansion valve 74 for expanding a refrigerant flowing to the second outdoor heat exchanger 24.

The first outdoor expansion valve 72 and the second outdoor expansion valve 74 are connected to the liquid pipe 12. During the heating operation, a refrigerant condensed in the indoor unit D is supplied to the first outdoor expansion valve 72 and the second outdoor expansion valve 74.

In order to be connected to the first outdoor expansion valve 72 and the second outdoor expansion valve 74, the liquid pipe 12 is branched and then connected to the first outdoor expansion valve 72 and the second outdoor expansion valve 74, respectively. The first outdoor expansion valve 72 and the second outdoor expansion valve 74 are arranged in parallel.

A pipe connecting the first outdoor expansion valve 72 and the first outdoor heat exchanger 22 is defined as a first outdoor heat exchanger pipe 23.

A pipe connecting the second outdoor expansion valve 74 and the second outdoor heat exchanger 24 is defined as a second outdoor heat exchanger pipe 25.

<Configuration of Hot Gas Unit>

In this embodiment, the hot gas unit 90 for bypassing a refrigerant, supplied to the outdoor heat exchanger 20 to the indoor unit D, during a heating operation is disposed.

The hot gas unit 90 includes a hot gas bypass pipe and a hot gas valve to bypass the refrigerant.

In this embodiment, a first hot gas bypass pipe 91 connecting the first outdoor heat exchanger pipe 23 and a four way valve-compressor connecting pipe 81 is disposed.

One end of the first hot gas bypass pipe 91 is connected to the first outdoor heat exchanger pipe 23, and the other end of the first hot gas bypass pipe 91 is connected to the four way valve-compressor connecting pipe 81.

In addition, a second hot gas bypass pipe 92 for connecting the second outdoor heat exchanger pipe 25 and the four way valve-compressor connecting pipe 81 is disposed.

One end of the second hot gas bypass pipe 92 is connected to the first outdoor heat exchanger pipe 23, and the other end of the second hot gas bypass pipe 92 is connected to the four way valve-compressor connecting pipe 81.

A first hot gas valve 93 is disposed at the first hot gas bypass pipe 91, and a second hot gas valve 94 is disposed at the second hot gas bypass pipe 92.

As the hot gas valve, a solenoid valve capable of adjusting an opening amount thereof is used, and even a shut-off valve may be used.

The first hot gas bypass pipe 91 and the second hot gas bypass pipe 92 may be connected to the four way valve-compressor connecting pipe 81, respectively, but in this embodiment, after being combined, the first hot gas bypass pipe 91 and the second hot gas bypass pipe 92 is connected as one pipe to the four way valve-compressor connecting pipe 81.

A three-way valve may be used to combine the first hot gas bypass pipe 91 and the second hot gas bypass pipe 92.

The first hot gas valve 93 or the second hot gas valve 94 may be selectively operated. For example, only the first hot gas valve 93 may be opened or closed, or only the second hot gas valve 94 may be opened or closed.

In addition, a variable path pipe 85 for connecting the first outdoor heat exchanger pipe 23 and the second four way valve-outdoor heat exchanger connecting pipe 83*b* is further disposed, and a variable path valve 86 may be further disposed at the variable path pipe.

The variable path valve 86 may be selectively operated. When the variable path valve 86 is opened, a refrigerant flowing along the first outdoor heat exchanger pipe 23 may pass through the variable path pipe 85 and the variable path valve 86 and be then guided to the third flow path 43 of the four way valve 40.

When the variable path valve 86 is closed, a refrigerant supplied through the first outdoor heat exchanger pipe 23 flows to the first outdoor heat exchanger 22 during a heating operation.

When the variable path valve 86 is closed, a refrigerant passing through the first outdoor heat exchanger 22 flows into the liquid pipe 12 through the first outdoor heat exchanger pipe 23 during a cooling operation.

A check valve 87 is disposed at the second four way valve-outdoor heat exchanger connecting pipe 83*b*, and the check valve 87 prevents a refrigerant supplied from the third flow path 43 from flowing into the second four way valve-outdoor heat exchanger connecting pipe 83*b*.

An expansion valve bypass pipe 88 connecting a front end and a rear end of the second outdoor expansion valve 74 is disposed. One end and the other end of the expansion valve bypass pipe 88 are connected to the second outdoor heat exchanger pipe 25.

A check valve 89 is also disposed at the expansion valve bypass pipe 88. The check valve 89 is configured to allow a refrigerant flowing from the second outdoor heat exchanger pipe 25 to the liquid pipe (12) to pass therethrough during a cooling operation. During a heating operation, a refrigerant flow in the opposite direction is blocked.

<Configuration of Subcooling Unit>

The subcooling unit 100 may be further disposed at the liquid pipe 12.

The subcooling unit 100 includes: a subcooling heat exchanger 101; a subcooling bypass pipe 102 passed by the liquid pipe 12 and connected to the subcooling heat exchanger 101; a first subcooling expansion valve 103 disposed at the subcooling bypass pipe 102 to selectively expand a refrigerant flowing therein; a subcooling-compressor connecting pipe 104 connecting the subcooling heat exchanger 101 and the compressor 10; and a second subcooling expansion valve 105 disposed at the subcooling-compressor connection valve 104 to selectively expand a refrigerant flowing therein.

In addition, the subcooling unit 100 further includes an accumulator bypass pipe 106 connecting the accumulator 30 and the subcooling-compressor connecting pipe 104, and the accumulator bypass pipe 106 provides a refrigerant of the accumulator to the second subcooling expansion valve 105.

A subcooling bypass valve 107 is further disposed at the accumulator bypass pipe 106.

The first subcooling expansion valve 103 expands the liquid refrigerant and provides the expanded refrigerant to the subcooling heat exchanger 101, and the expanded refrigerant is evaporated in the subcooling heat exchanger 101, thereby cooling the subcooling heat exchanger 101. A liquid refrigerant flowing into the outdoor heat exchanger 20 through the liquid pipe 12 may be cooled while passing through the subcooling heat exchanger 101. The first subcooling expansion valve 103 may be selectively operated and may control a temperature of the liquid refrigerant.

When the first subcooling expansion valve 103 is operated, the second subcooling expansion valve 105 is opened and the refrigerant flows into the compressor 10.

Temperature sensors are disposed at an inlet side and an outlet side of the subcooling heat exchanger 101, respectively, and detect a temperature of a refrigerant passing therethrough.

The subcooling bypass valve 107 may be selectively operated and may provide a liquid refrigerant of the accumulator 30 to the second subcooling expansion valve 105.

The second subcooling expansion valve 105 may be selectively operated and may expand a refrigerant to lower a temperature of a refrigerant which is to be supplied to the compressor 10. When the compressor 10 exceeds a normal operating temperature range, the refrigerant expanded in the second subcooling expansion valve 105 may be evaporated in the compressor 10, thereby lowering a temperature of the compressor 10.

<Configuration of Receiver Unit>

A receiver unit 110 may be further disposed at the liquid pipe 12.

The receiver 110 may store a liquid refrigerant to control the amount of refrigerants to circulate. The receiver 110 stores the liquid refrigerant separately from the liquid refrigerant stored in the accumulator 30.

The receiver 110 supplies the refrigerant to the accumulator 30 when the amount of circulating refrigerants is insufficient, and when the amount of circulating refrigerant is large, the refrigerant is recovered and stored.

A pipe connecting the outdoor expansion valves 72 and 74 and the subcooling heat exchanger 101 among the liquid pipes 12 is defined as a subcooling liquid pipe 12'.

The receiver 110 includes a receiver tank 111 for storing a refrigerant, a first receiver connecting pipe 112 connecting the receiver tank 111 and the subcooling liquid pipe 12', a second receiver connecting pipe 114 connecting the receiver tank 111 and the accumulator 30, a first receiver valve 113 disposed at the first receiver connecting pipe 112 to regulate a refrigerant flow, and a second receiver valve 115 disposed at the second receiver connecting pipe 114 to regulate a refrigerant flow.

A controller of the multi-type air conditioner controls the first receiver valve 113 and the second receiver valve 115 to adjust the amount of circulating refrigerant.

<Configuration of Indoor Unit>

The indoor unit D may be operated for cooling, heating, or dehumidifying air by a refrigerant supplied from the outdoor unit. The indoor unit D may be provided in plural (as a plurality of indoor units D C1, C2, and C3 in this embodiment).

The plurality of indoor units C1, C2, and C3 each includes an indoor heat exchanger, an indoor expansion valve, and an indoor blower fan.

Although not additionally described, various structures which can be sufficiently known to a person skilled in the art, such as a pressure switch, a pressure sensor, a temperature sensor, a check valve, a strainer, and the like, are installed in the outdoor unit A or the indoor unit D.

At least one indoor unit C1 among the plurality of indoor units has a structure capable of providing dehumidification at a constant temperature. The remaining indoor units C2 and C3 may be indoor units each having a general structure.

In this embodiment, the indoor unit providing dehumidification at a constant temperature is defined as a first indoor unit C1, and the remaining indoor units are defined as a second indoor unit C2 and a third indoor unit C3.

The first indoor unit C1 provides a constant temperature dehumidification function to operate a room temperature within a predetermined temperature range.

In this embodiment, the first indoor unit C1 and the second and third indoor units C2 and C3 have different structures, but unlike the this embodiment may also have the same structure as a structure of the first indoor unit C1.

The first indoor unit C1 may be installed in a specific room where dehumidification is required. For example, the first indoor unit C1 may be installed in an indoor space in which humidity and temperature must be kept constant, such as a dress room.

In addition, the first indoor unit C1 may be installed in an indoor space in which a large amount of humidification is frequently formed, such as a toilet.

The first indoor unit C1 includes a first indoor heat exchanger 210, a first indoor expansion valve 214, and a first indoor fan 213.

The second indoor unit C2 includes a second indoor heat exchanger 220, a second indoor expansion valve 224, and a second indoor fan 226.

The third indoor unit C3 includes a third indoor heat exchanger 230, a third indoor expansion valve 234, and a third indoor fan 236.

In addition, refrigerant pipes are arranged to allow refrigerants of the outdoor unit and the indoor unit to flow.

A liquid pipe connecting tube 214 connecting the liquid pipe 12 and a plurality of indoor units C1, 02, and C3 is arranged to flow a refrigerant. A refrigerant distributor 245 may be disposed in the liquid pipe connecting tube 241 to be connected to each of the indoor heat exchangers 210, 220, and 230.

A refrigerant pipe connecting the distributor 245 and the first indoor heat exchanger 210 is defined as a first liquid branch pipe 242. A refrigerant pipe connecting the distributor 245 and the second indoor heat exchanger 220 is defined as a second gas branch pipe 244. A refrigerant pipe connecting the distributor 245 and the third indoor heat exchanger 230 is defined as a third gas branch pipe 246.

A liquid refrigerant mainly flows in the first liquid branch pipe 242, the second liquid branch pipe 244, and the third liquid branch pipe 246.

The respective indoor heat exchangers 210, 220, and 230 are connected in parallel to the distributor 245.

A gas pipe connecting tube 251 which connects the gas pipe 82 and each of the indoor heat exchangers 210, 220, and 230 is disposed. The distributor 255 may be disposed in the gas pipe connecting tube 251 to be connected to each of the indoor heat exchangers 210, 220 and 230.

A refrigerant pipe connecting the distributor 255 and the first indoor heat exchanger 210 is defined as a first gas branch pipe 252. A refrigerant pipe connecting the distributor 255 and the second indoor heat exchanger 220 is defined as a second gas branch pipe 254. A refrigerant pipe connecting the distributor 255 and the third indoor heat exchanger 230 is defined as a third gas branch pipe 256.

A gas refrigerant mainly flows in the first gas branch pipe 252, the second gas branch pipe 254, and the third gas branch pipe 256.

The respective indoor heat exchangers 210, 220, and 230 are connected in parallel to the distributor 255.

<Structure of First Indoor Unit (C1)>

The first indoor heat exchanger 210 is arranged in at least two rows, each row stacked.

The first indoor heat exchanger 2210 includes a first heat exchanger 211 and a second heat exchanger 212, and the first heat exchanger 211 and the second heat exchanger 212 are arranged in a stacked fashion.

During a dehumidifying operation, a refrigerant is evaporated in one of the first heat exchange part 211 and the second heat exchange part 212, and a refrigerant is evaporated in the other. It is preferable that the heat exchanger where a refrigerant is condensed is disposed in a discharge side of an indoor unit.

The first liquid branch pipe 242 is connected to one side of the first heat exchanger 211, and the first gas branch pipe 252 is connected to one side of the second heat exchanger 212.

A first heat exchanger connecting pipe 261 is disposed on the other side of the first heat exchange part 211, and a second heat exchanger connecting pipe 262 is disposed on the other side of the second heat exchange part 212.

The first heat exchanger connecting pipe 261 and the second heat exchanger connecting pipe 262 are connected to a return pipe 243, and the return pipe 243 is connected to the first gas branch pipe 252. The first heat exchanger connecting pipe 261 and the second heat exchanger connecting pipe 262 may be connected to the return pipe 243 through a three-way valve or a T-type pipe.

One end of the return pipe 243 is connected to the first gas branch pipe 252, and the other end is branched from the first heat exchanger connecting pipe 261 and the second heat exchanger connecting pipe 262.

With reference to one end of the return pipe, the first gas branch pipe 252 is defined as including a first gas branch pipe 252' on a side of the distributor 255 and a first gas branch pipe 252" on a side of the first indoor heat exchanger.

In this embodiment, the first indoor expansion valve 214 is disposed at the second heat exchanger connecting pipe 262, and the first expansion valve 216 is disposed at the return pipe 243.

For the expansion valve of this embodiment, an electronic expansion valve of which an opening amount is controlled by a control signal from the controller is used.

Meanwhile, in this embodiment, a heat pump capable of performing both a heating operation and a cooling operation is described as an example, but unlike the present embodiment, even if an outdoor unit operated only by a refrigeration cycle is disposed, the first indoor unit operated in a constant temperature dehumidification mode may be operated.

<Heating Operation>

A refrigerant flow during a heating operation of the multi-type air conditioner according to this embodiment will be described in more detail with reference to FIG. 2.

During the heating operation, a refrigerant compressed in the compressor 10 flows through the oil separator 50 to the first flow path 41 of the four way valve 40.

The controller controls the refrigerant introduced into the first flow path 41 of the four way valve 40 to flow into the second flow path 42. The refrigerant flowing out of the second flow path 42 is supplied to the indoor unit D through the gas pipe 82. In the indoor unit D, the supplied refrigerant is condensed and an indoor space is heated with heat released in the condensation process of the refrigerant.

During the heating operation, a refrigerant is supplied to the indoor heat exchangers 210, 220, and 230 of the respective indoor units through the gas pipe connecting tube 251.

A refrigerant condensed in the second indoor unit C2 and the third indoor unit C3 is recovered into the liquid pipe 12 after passing through "the gas branch pipes 244 and 246→ the distributor 245→ the liquid pipe connecting tube 241".

The refrigerant introduced into the liquid pipe 12 is provided to the outdoor expansion valve 70 after passing through the subcooling unit 100.

The first outdoor expansion valve 72 and the second outdoor expansion valve 74 expand the condensed refrigerant and then supply the expanded refrigerant to the outdoor heat exchanger 20.

The refrigerant expanded in the first outdoor expansion valve 72 is provided to the first outdoor heat exchanger 22, and the refrigerant expanded in the second outdoor expansion valve 74 is provided to the second outdoor heat exchanger 24.

The first outdoor expansion valve 72 and the second outdoor expansion valve 74 evaporate the expanded refrigerant, and the evaporated refrigerant is converged and flows into the third flow path 43 of the four way valve 40.

The refrigerant flowing into the third flow path 43 is supplied to the accumulator 30 through the fourth flow path 44.

The accumulator 30 stores a liquid refrigerant among supplied refrigerants, and supplies only a gas refrigerant to the compressor 10.

In a general heating operation, the first hot gas valve 93, the second hot gas valve 94, and the variable path valve 86 are turned off to maintain a closed state.

<Cooling Operation>

A refrigerant flow during a cooling operation of the multi-type air conditioner according to this embodiment will be described in more detail with reference to FIG. 3.

During the cooling operation, a refrigerant compressed in the compressor 10 flows through the oil separator 50 to the first flow path 41 of the four way valve 40.

The controller controls the refrigerant introduced into the first flow path 41 of the four way valve 40 to flow into the third flow path 43. The refrigerant introduced into the third flow path 43 flows to the outdoor heat exchanger 20.

The refrigerant is supplied to the first outdoor heat exchanger 22 through the first four way valve-outdoor heat exchanger connecting pipe 83*a*, and to the second outdoor heat exchanger 24 through the second four way valve-outdoor heat exchanger connecting pipe 83*b*.

The refrigerant exchanged in the first outdoor heat exchanger 22 and the second outdoor heat exchanger 24 is supplied to the indoor unit D through the liquid pipe 12.

The indoor heat exchanger of the indoor unit D cools an indoor space by evaporating the supplied refrigerant, and the evaporated refrigerant is recovered into the outdoor unit through the gas pipe 82.

Here, a refrigerant of the liquid pipe 12 flows to each of the indoor heat exchangers 210, 220 and 230 through the liquid pipe connecting tube 241 and the distributor 245.

The refrigerant flown into the second liquid branch pipe 244 or the third liquid branch pipe 246 may be expanded in the second indoor expansion valve 224 or the third indoor expansion valve 234, respectively, and be then evaporated in the second indoor heat exchange 220 or the third indoor heat exchanger 230, respectively.

The refrigerant evaporated in the second indoor unit C2 or the third indoor unit C3 may be recovered into the gas pipe 82 through the second gas branch pipe 254 or the third gas branch pipe 255.

The evaporated refrigerant is recovered through the second flow path 42 of the four way valve 40, and the controller connects the second flow path 42 and the fourth flow path 44 to cause the recovered refrigerant to flow to the accumulator 30. The accumulator 30 stores a liquid refrigerant among the recovered refrigerant, and supplies a gas refrigerant to the compressor 10.

During the cooling operation, an opening amount of at least one of the first outdoor expansion valve 72 or the second outdoor expansion valve 74 may be adjusted to evaporate a refrigerant in the first heat exchanger 211. That is, the opening amount of the first outdoor expansion valve 72 or the second outdoor expansion valve 74 may be adjusted to expand a portion of the refrigerant condensed in the outdoor heat exchangers 22 and 24, and accordingly, the portion of the refrigerant may be evaporated in the first heat exchanger 211.

<Constant Temperature Dehumidifying Operation of First Indoor Unit>

Figure 4:
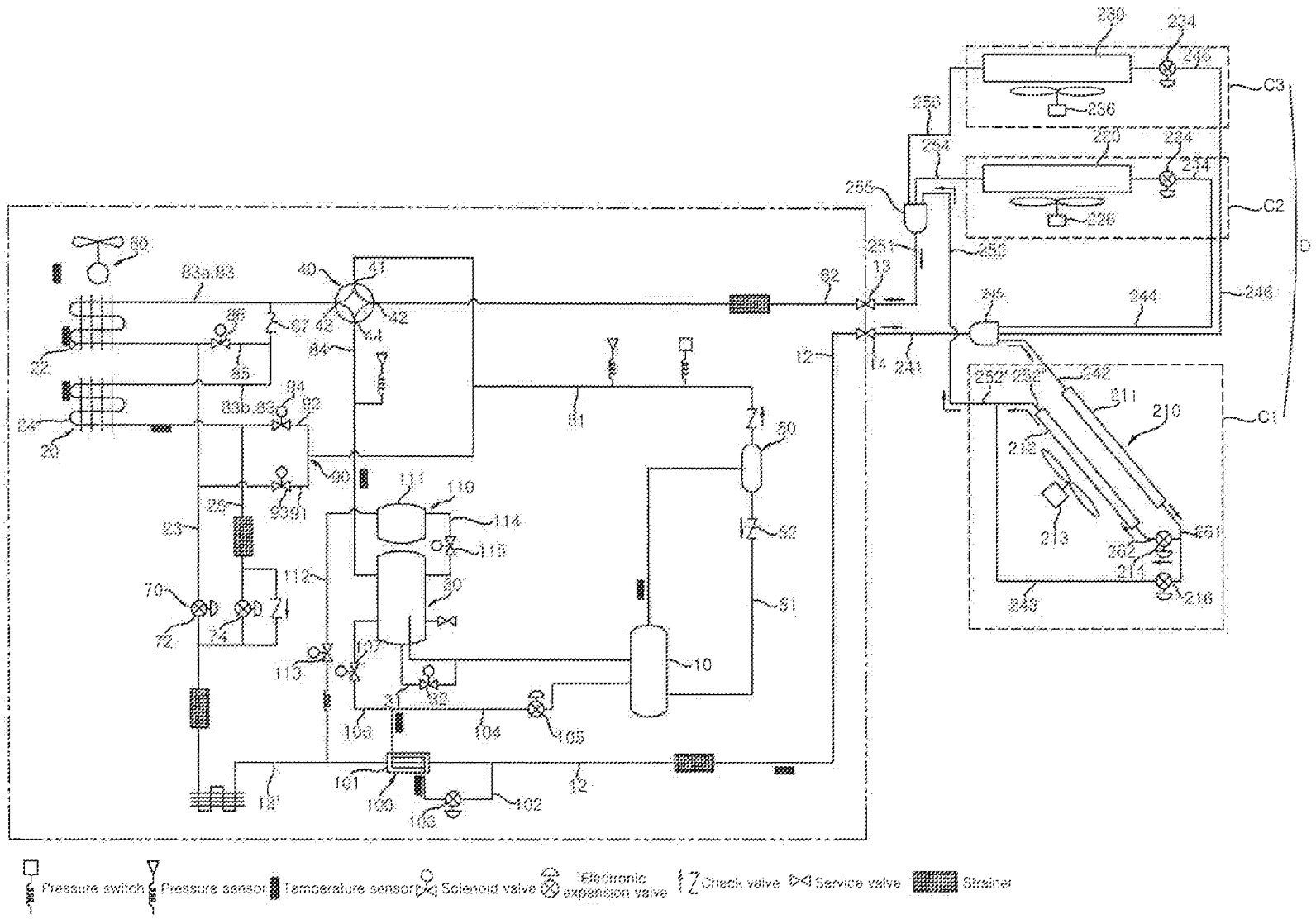
FIG. 4 is an exemplary diagram showing a refrigerant flow during a dehumidifying operation in the multi-type air conditioner illustrated in FIG. 1.

A constant temperature dehumidifying operation of the first indoor unit C1 will be described with reference to FIG. 4.

During a constant temperature dehumidifying operation of the first indoor unit C1, the first heat exchanger 211 is controlled to condense a refrigerant, and the second heat exchanger 212 is controlled to evaporate a refrigerant.

To this end, the controller opens the first indoor expansion valve 214 and closes the first expansion valve 216. In this case, the refrigerant supplied to the first heat exchanger 211 through the first liquid branch pipe 242 flows through the first indoor expansion valve 214 to the second heat exchanger 212 and is blocked from flowing to the return pipe 243.

The controller may control the opening amount of the first indoor expansion valve 214 and may control the amount of refrigerant to be evaporated in the second heat exchanger 212.

The first indoor fan 213 causes suctioned air to flow from the second heat exchanger 212 to the first heat exchanger 211. The suctioned indoor air is dehumidified while passing through the second heat exchanger 212 and then heated by condensation heat of the first heat exchanger 211, and a discharge temperature of the indoor air may be maintained with a predetermined range even if the first indoor unit C1 is continuously operated.

In order to condense the refrigerant in the first heat exchanger 211, the controller adjusts the number of rotation of the outdoor blower fan 60. The controller reduces a rotational speed of the outdoor blower fan so that even when a gas refrigerant of high temperature and high pressure passes through the first outdoor heat exchanger 22 and the second outdoor heat exchanger 24, a portion of the gas refrigerant remains with the high temperature and the high pressure.

That is, the remaining gas refrigerant of the high temperature and the high pressure may be controlled to be condensed in the first heat exchanger 211.

During the constant temperature dehumidifying operation, the controller fully opens the first outdoor expansion valve 72 and the second outdoor expansion valve 74 to allow a refrigerant to pass therethrough.

When only the first indoor unit C1 is operated for the constant temperature dehumidification, the controller may control a refrigerant to be supplied to either the first outdoor heat exchanger 22 or the second outdoor heat exchanger 24.

When the second indoor unit C2 or the third indoor unit C3 is not operated during the constant temperature dehumidifying operation of the first indoor unit C1, the controller closes the second indoor expansion valve 244 or the third indoor expansion valve 246 to block a refrigerant.

On the other hand, when the second indoor unit C2 or the third indoor unit C3 is operated, the controller adjust the opening amount of the second indoor expansion valve 244 or the third indoor expansion valve 246 to correspond to a cooling load of the second indoor unit C2 or the third indoor unit C3.

The multi-type air conditioner according to this embodiment may connect a plurality of indoor units and an outdoor unit with only two pipes (the liquid pipe 12 and the gas pipe 82) and may operate at least one of the plurality of indoor units in a constant temperature dehumidifying mode.

In this embodiment, a refrigerant supplied through the first liquid branch pipe 242 is a refrigerant in a gaseous and liquid state. Unlike this embodiment, the refrigerant supplied through the first liquid branch pipe 242 may be a liquid refrigerant. Depending on a room temperature, condensation heat may not necessarily discharged from the first heat exchanger 211, and in this case, only the liquid refrigerant may be supplied, thereby minimizing the supply of the condensation heat.

<Cooling Operation of First Indoor Unit>

During a cooling operation of the first indoor unit C1, the first heat exchanger 211 is controlled to minimize refrigerant condensation and the second heat exchanger 212 is controlled to evaporate a refrigerant.

To this end, the controller opens the first indoor expansion valve 214 and closes the first expansion valve 216. In the case of the cooling operation, a liquid refrigerant supplied through the first liquid branch pipe 242 is provided to the first heat exchanger 211.

A refrigerant supplied through the first liquid branch pipe 242 passes through the first heat exchanger 211, is expanded in the first indoor expansion valve 214, flows to the second heat exchanger 212, and is then evaporated in the second heat exchanger 212. The first expansion valve 216 is closed, thereby blocking a refrigerant flow to the return pipe 243.

<Heating Operation of First Indoor Unit>

During a heating operation of the first indoor unit C1, it is controlled to condense a refrigerant in the first heat exchanger 211 and the second heat exchanger 212.

To this end, the controller fully opens the first indoor expansion valve 214 and closes the first expansion valve 216. In the case of heating operation, a gas refrigerant is provided to the first heat exchanger 211 through the first gas branch pipe 252.

The gas refrigerant may be condensed while passing through the first heat exchanger 211 and the second heat exchanger 212 and may heat indoor air through condensation heat of the refrigerant. A condensed refrigerant is recovered into the liquid pipe 12 through the first liquid branch pipe 242.

Figure 5:
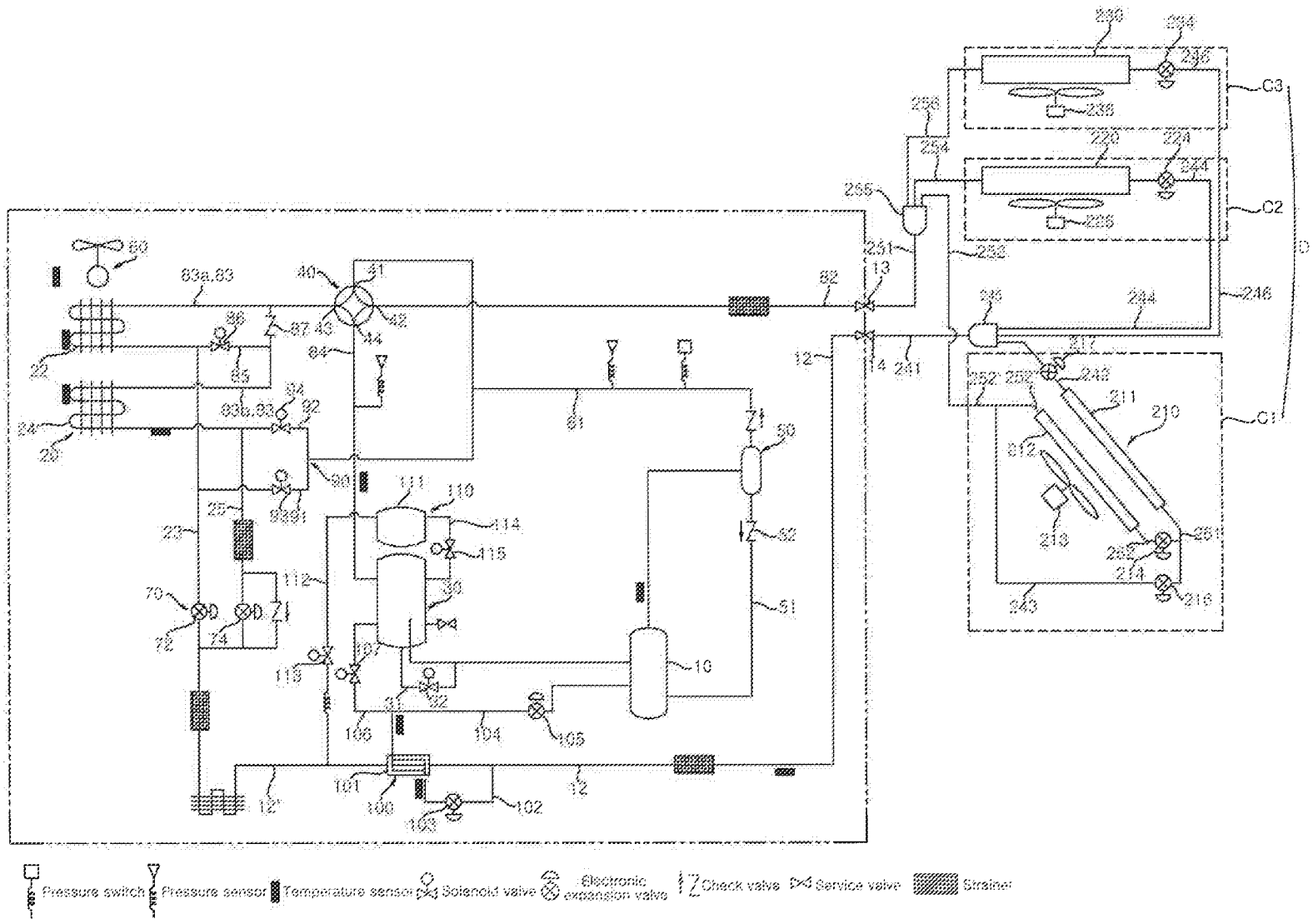
FIG. 5 is a diagram illustrating a configuration of a multi-type air conditioner according to a second embodiment of the present disclosure.

FIG. 5 is a diagram illustrating a configuration of a multi-type air conditioner according to a second embodiment of the present disclosure.

The first indoor unit C1 according to the second embodiment of the present disclosure further includes a second expansion valve 217 disposed in the first liquid pipe branch pipe 242.

<Constant Temperature Dehumidifying Operation of First Indoor Unit>

During a constant temperature dehumidifying operation of the first indoor unit C1, the first heat exchanger 211 is controlled to condense a refrigerant, and the second heat exchanger 212 is controlled to evaporate a refrigerant.

To this end, the controller opens the first indoor expansion valve 214, closes the first expansion valve 216, and opens the second expansion valve 217. In particular, the second expansion valve 217 is fully opened, instead of having the opening amount thereof adjusted, so that a supplied refrigerant passes therethrough.

In this case, the refrigerant supplied to the first heat exchanger 211 through the first liquid branch pipe 242 flows through the first indoor expansion valve 214 to the second heat exchanger 212 and is blocked from flowing to the return pipe 243.

The controller may control the opening amount of the first indoor expansion valve 214 and may control the amount of refrigerant to be evaporated in the second heat exchanger 212.

The first indoor fan 213 causes suctioned air to flow from the second heat exchanger 212 to the first heat exchanger 211. The suctioned indoor air is dehumidified while passing through the second heat exchanger 212 and then heated by condensation heat of the first heat exchanger 211, and a discharge temperature of the indoor air may be maintained with a predetermined range even if the first indoor unit C1 is continuously operated.

In order to condense the refrigerant in the first heat exchanger 211, the controller adjusts the number of rotation of the outdoor blower fan 60. The controller reduces a rotational speed of the outdoor blower fan so that even when a gas refrigerant of high temperature and high pressure passes through the first outdoor heat exchanger 22 and the second outdoor heat exchanger 24, a portion of the gas refrigerant remains with the high temperature and the high pressure.

When the second indoor unit C2 or the third indoor unit C3 is not operated during the constant temperature dehumidifying operation of the first indoor unit C1 the controller closes the second indoor expansion valve 244 or the third indoor expansion valve 246 to block a refrigerant.

On the other hand, when the second indoor unit C2 or the third indoor unit C3 is operated, the controller adjust the opening amount of the second indoor expansion valve 244 or the third indoor expansion valve 246 to correspond to a cooling load of the second indoor unit C2 or the third indoor unit C3.

The multi-type air conditioner according to this embodiment may connect a plurality of indoor units and an outdoor unit with only two pipes (the liquid pipe 12 and the gas pipe 82) and may operate at least one of the plurality of indoor units in a constant temperature dehumidifying mode.

In this embodiment, a refrigerant supplied through the first liquid branch pipe 242 is a refrigerant in a gaseous and liquid state.

<Cooling Operation of First Indoor Unit>

During the cooling operation of the first indoor unit C1, the first heat exchanger 211 and the second heat exchanger 212 are controlled to evaporate the refrigerant.

To this end, the controller opens the second expansion valve 217, opens the first indoor expansion valve 214, and closes the first expansion valve 216.

In the case of cooling operation, the liquid refrigerant supplied through the first liquid branch pipe 242 is expanded by adjusting the opening amount of the second expansion valve 217. The expanded refrigerant is evaporated in the first heat exchange part 211 and the second heat exchange part 212. The first expansion valve 216 is closed, thereby blocking a refrigerant flow to the return pipe 243.

The refrigerant exchanged in the first heat exchanger 211 and the second heat exchanger 212 is recovered into the gas pipe 82 through the first gas branch pipe 252.

<Heating Operation of First Indoor Unit>

During a heating operation of the first indoor unit C1, it is controlled to condense a refrigerant in the first heat exchanger 211 and the second heat exchanger 212.

To this end, the controller fully opens the first indoor expansion valve 214, closes the first expansion valve 216, and also fully opens the second expansion valve 217.

The first indoor expansion valve 214 and the second expansion valve 217 are fully opened, thereby minimizing pressure loss of the refrigerant. The first expansion valve 216 is closed, thereby blocking a refrigerant flow to the return pipe 243.

The gas refrigerant is condensed while passing through the second heat exchanger 212 and the first heat exchanger 211, and may heat indoor air with condensation heat of the refrigerant. A condensed refrigerant is recovered into the liquid pipe 12 through the first liquid branch pipe 242.

Hereinafter, other configurations are the same as those of the first embodiment, so a detailed description is omitted.

Figure 6:
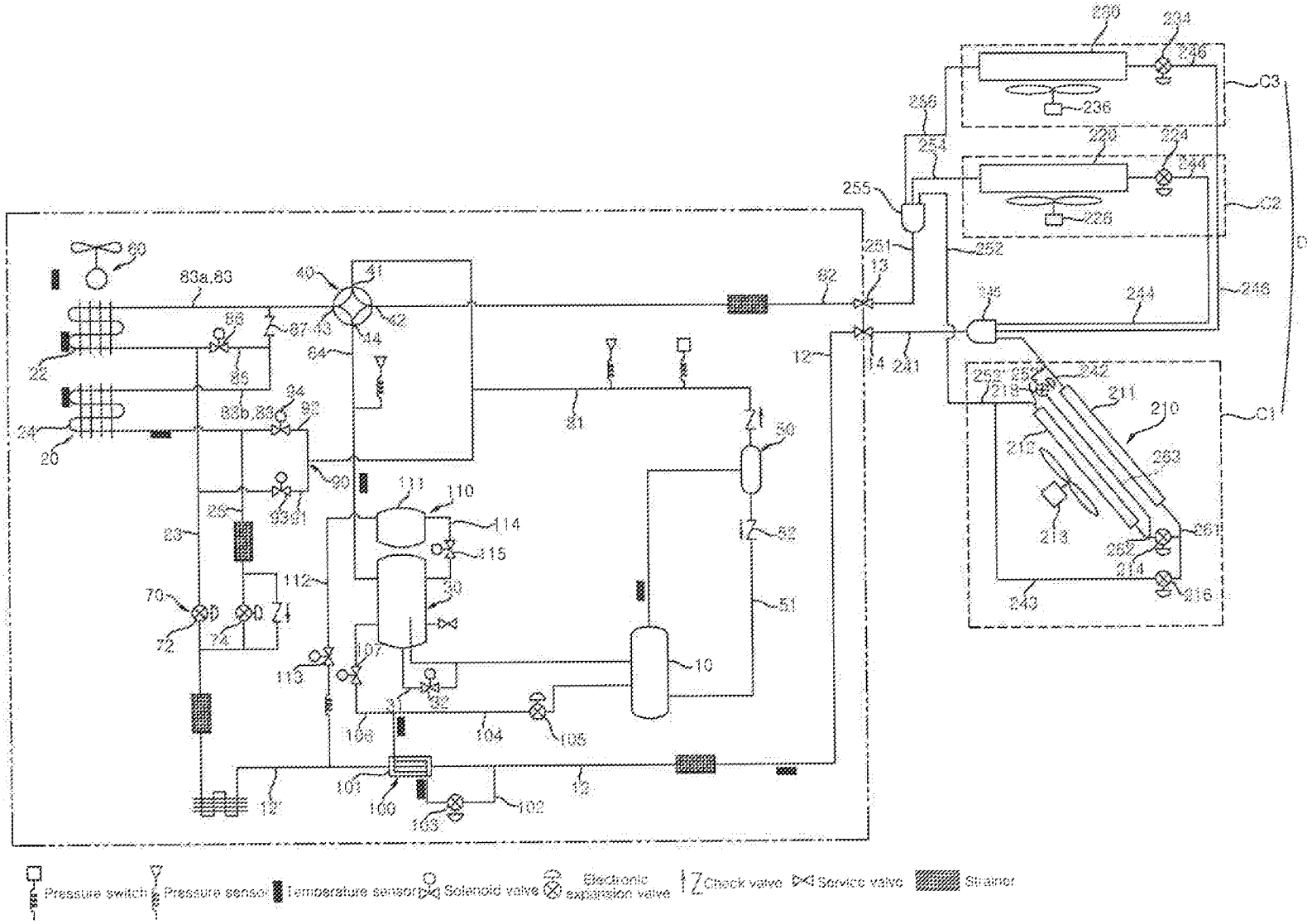
FIG. 6 is a diagram illustrating a configuration of a multi-type air conditioner according to a third embodiment of the present disclosure.

FIG. 6 is a diagram illustrating a configuration of a multi-type air conditioner according to a third embodiment of the present disclosure.

The first indoor unit C1 according to the third embodiment of the present disclosure further includes a heat exchanger bypass pipe 263 connecting the first liquid branch pipe 242 and the second heat exchanger connecting pipe 262, and a third expansion valve 218 disposed at the heat exchanger bypass pipe 263 to selectively expand a refrigerant flowing therein.

<Constant Temperature Dehumidifying Operation of First Indoor Unit>

During a constant temperature dehumidifying operation of the first indoor unit C1, the first heat exchanger 211 is controlled to condense a refrigerant, and the second heat exchanger 212 is controlled to evaporate a refrigerant.

To this end, the controller opens the first indoor expansion valve 214, closes the first expansion valve 216, and closes the third expansion valve 218.

In this case, a refrigerant supplied to the first heat exchanger 211 through the first liquid branch pipe 242 flows through the first indoor expansion valve 214 to the second heat exchanger 212. The refrigerant flowing through the first heat exchanger connecting pipe 261 flows only to the second heat exchange part 212 through the second heat exchanger connecting pipe 262, and is blocked from flowing to the return pipe 234 and the heat exchange part bypass pipe 263.

The controller may control the opening amount of the first indoor expansion valve 214 and may control the amount of refrigerant to be evaporated in the second heat exchanger 212.

When the second indoor unit C2 or the third indoor unit C3 is not operated during the constant temperature dehumidifying operation of the first indoor unit C1, the controller closes the second indoor expansion valve 244 or the third indoor expansion valve 246 to block a refrigerant.

On the other hand, when the second indoor unit C2 or the third indoor unit C3 is operated, the controller adjust the opening amount of the second indoor expansion valve 244 or the third indoor expansion valve 246 to correspond to a cooling load of the second indoor unit C2 or the third indoor unit C3.

When the second indoor unit C2 or the third indoor unit C3 is operated during the constant temperature dehumidifying operation of the first indoor unit C1, the controller opens the first indoor expansion valve 214 and the first expansion valve 216 and closes the third expansion valve 218.

When the second indoor unit C2 or the third indoor unit C3 is operated during the constant temperature humidifying operation of the first indoor unit C1, a subcooled refrigerant should be introduced to prevent noise and to secure a cooling capacity of the indoor unit, and therefore, there is insufficient amount of condensation heat. Therefore, in order to maintain a reduction in temperature of refrigerant passing through the evaporator at an appropriate level, some of the condensed refrigerant is bypassed to reduce the amount of evaporation heat to the level of condensation heat.

The multi-type air conditioner according to this embodiment may connect a plurality of indoor units and an outdoor unit with only two pipes (the liquid pipe 12 and the gas pipe 82) and may operate at least one of the plurality of indoor units in a constant temperature dehumidifying mode.

In this embodiment, a refrigerant supplied through the first liquid branch pipe 242 is a refrigerant in a gaseous and liquid state.

<Cooling Operation of First Indoor Unit>

During a cooling operation of the first indoor unit C1, it is controlled to block a refrigerant flow to the first heat exchanger 211 and to evaporate a refrigerant in the second heat exchanger 212.

To this end, the controller opens the third expansion valve 218, closes the first indoor expansion valve 214, and closes the first expansion valve 216.

In the case of the cooling operation, a liquid refrigerant supplied through the first liquid branch pipe 242 is expanded by adjusting the opening amount of the third expansion valve 218. The expanded refrigerant is evaporated in the second heat exchanger 212. The first expansion valve 216 is closed, thereby blocking a refrigerant flow to the return pipe 243.

A refrigerant heat-exchanged in the second heat exchanger 212 is recovered into the gas pipe 82 through the first gas branch pipe 252.

<Heating Operation of First Indoor Unit>

During a heating operation of the first indoor unit C1, it is controlled to condense a refrigerant in the first heat exchanger 211 and the second heat exchanger 212.

To this end, the controller fully opens the first indoor expansion valve 214, closes the first expansion valve 216, and closes the third expansion valve 218.

The first indoor expansion valve 214 is fully open, thereby minimizing pressure loss of the refrigerant. The first expansion valve 216 is closed, thereby blocking a refrigerant flow to the return pipe 243. The third expansion valve 218 is closed, thereby blocking a refrigerant flow to the heat exchanger bypass pipe 263.

The gas refrigerant is condensed while passing through the second heat exchanger 212 and the first heat exchanger 211, and may heat indoor air with condensation heat of the refrigerant. A condensed refrigerant is recovered into the liquid pipe 12 through the first liquid branch pipe 242.

Other configurations are the same as those of the first embodiment, so a detailed description is hereinafter omitted.

It should be understood that many variations and modifications of the basic inventive concept herein described, which may be apparent to those skilled in the art, will still fall within the spirit and scope of the embodiments of the invention. Therefore, it should be understood that the embodiments described above are illustrative in all respects and not restrictive. The scope of the present disclosure is indicated by the scope of the claims, which will be described later, rather than the detailed description, and all the modified or modified forms derived from the meaning and scope of the claims and their equivalent concepts are included in the scope of the present disclosure.

The invention claimed is:

1. A multi-type air conditioner, comprising:

an outdoor unit comprising a liquid pipe through which a liquid refrigerant flows, and a gas pipe through which a gas refrigerant flows;

a plurality of indoor units comprising a first indoor unit and a second indoor unit each connected to the liquid pipe and the gas pipe to circulate a refrigerant;

a gas pipe connecting tube connecting the gas pipe and the plurality of indoor units so that a gas refrigerant flows therethrough; and a liquid pipe connecting tube connecting the liquid pipe and the plurality of indoor units so that a liquid refrigerant flows therethrough, wherein the first indoor unit comprises:

a first indoor heat exchanger comprising a first heat exchanger configured to perform heat exchange between indoor air and a refrigerant, and a second heat exchanger configured to perform heat exchange between indoor air and a refrigerant and arranged in a stacked fashion with the first heat exchanger;

a first indoor fan configured to blow air to the first heat exchanger and the second heat exchanger;

a first liquid branch pipe connecting the liquid pipe connecting tube and the first heat exchanger so that a refrigerant flows therethrough;

a first gas branch pipe connecting the gas pipe connecting tube and the second heat exchanger so that a refrigerant flows therethrough;

a first heat exchanger connecting pipe connected to the first heat exchanger so that a refrigerant flows therethrough;

a second heat exchanger connecting pipe connected to the second heat exchanger so that a refrigerant flows therethrough;

a return pipe having one side connected to the first gas branch pipe and the other side connected to the first heat exchanger connecting pipe and the second heat exchanger connecting pipe;

a first indoor expansion valve disposed at the second heat exchanger connecting pipe, wherein an opening amount of the first indoor expansion valve is adjusted in response to an input signal from a controller to selectively expand a flowing refrigerant; and a first expansion valve disposed in the return pipe, wherein an opening amount of the first expansion valve is adjusted in response to an input signal from the controller to selectively expand a flowing refrigerant.

2. The multi-type air conditioner of claim 1, wherein during a constant temperature dehumidifying operation of the first indoor unit, the first indoor expansion valve is opened and the first expansion valve is closed.

3. The multi-type air conditioner of claim 2, wherein during the constant temperature dehumidifying operation of the first indoor unit, a refrigerant supplied to the first indoor unit is in a gaseous state and a liquid state.

4. The multi-type air conditioner of claim 1, wherein during a cooling operation of the first indoor unit, the first indoor expansion valve is opened and the first expansion valve is closed.

5. The method according to claim 4, wherein during the cooling operation of the first indoor unit, a refrigerant supplied to the first indoor unit is in a liquid phase.

6. The multi-type air conditioner of claim 1, further comprising a second expansion valve disposed at the first liquid pipe branch pipe, wherein an opening amount of the second expansion valve is adjusted in response to an input signal from the controller to selectively expand a flowing refrigerant.

7. The method according to claim 6, wherein during a constant temperature dehumidifying operation of the first indoor unit, the first indoor expansion valve is opened, the first expansion valve is closed, and the second expansion valve is opened.

8. The method according to claim 6, wherein during the cooling operation of the first indoor unit, the second expansion valve is opened, the first indoor expansion valve is opened, and the first expansion valve is closed.

9. The multi-type air conditioner of claim 1, further comprising:

a heat exchanger bypass pipe connecting the first liquid branch pipe and the second heat exchanger connecting pipe; and a third expansion valve disposed at the heat exchanger bypass pipe, wherein an opening amount of the third expansion valve is adjusted in response to an input signal from the controller to selectively expand a flowing refrigerant.

10. The method according to claim 9, wherein during a constant temperature dehumidifying operation of the first indoor unit, the first indoor expansion valve is opened, the first expansion valve is closed, and the third expansion valve is closed.

11. The method according to claim 9, wherein during the cooling operation of the first indoor unit, the third expansion valve is opened, the first indoor expansion valve is closed, and the first expansion valve is closed.

* * * * *